US009673580B2

(12) United States Patent
Yu

(10) Patent No.: US 9,673,580 B2
(45) Date of Patent: Jun. 6, 2017

(54) ELECTRICAL CONNECTOR WITH IMPROVED CONTACTS

(71) Applicant: FOXCONN INTERCONNECT TECHNOLOGY LIMITED, Grand Cayman (KY)

(72) Inventor: Chun-Ming Yu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 226 days.

(21) Appl. No.: 14/565,451

(22) Filed: Dec. 10, 2014

(65) Prior Publication Data

US 2015/0162714 A1 Jun. 11, 2015

(30) Foreign Application Priority Data

Dec. 11, 2013 (CN) ..... 2013 2 0807357 U

(51) Int. Cl.

| | |
|---|---|
| ***H01R 3/00*** | (2006.01) |
| ***H01R 24/62*** | (2011.01) |
| *H01R 107/00* | (2006.01) |
| *H01R 12/72* | (2011.01) |
| *H01R 13/6594* | (2011.01) |

(52) U.S. Cl.

CPC ..... *H01R 24/62* (2013.01); *H01R 12/724* (2013.01); *H01R 13/6594* (2013.01); *H01R 2107/00* (2013.01)

(58) Field of Classification Search

CPC ..... H01R 13/641
USPC ..... 439/489, 660
See application file for complete search history.

(56) References Cited

U.S. PATENT DOCUMENTS

| | | | | |
|---|---|---|---|---|
| 5,773,901 | A * | 6/1998 | Kantner | H01R 27/00 307/112 |
| 7,727,026 | B2 * | 6/2010 | Qin | H01R 13/7033 439/607.34 |
| 8,206,174 | B2 * | 6/2012 | Ko | H01R 13/703 439/489 |
| 8,246,359 | B2 * | 8/2012 | Sloey | H01R 13/405 439/660 |
| 8,690,608 | B2 * | 4/2014 | Naito | H01R 13/7039 439/607.01 |
| 8,747,147 | B2 * | 6/2014 | Yu | H01R 13/7031 439/108 |

(Continued)

FOREIGN PATENT DOCUMENTS

CN 202712639 U 1/2013

*Primary Examiner* — Neil Abrams
(74) *Attorney, Agent, or Firm* — Wei Te Chung; Ming Chieh Chang

(57) ABSTRACT

An electrical connector (100) includes an insulative housing (1), a plurality of terminals (2) received in the insulative housing, and a shell (3). The insulative housing includes a base portion (11) and a tongue plate (12) extending from the base portion forwardly. The tongue plate includes a mating face (13) and a supporting face (14) opposite to the mating face. The terminals (22) include a pair of signal terminals defined in the supporting face, a grounding terminal, and a power terminal. The pair of signal terminals are defined between the grounding terminal and the power terminal. Each of the signal terminals, the grounding terminal, and the power terminal has a thickness greater than 0.2 mm. The power terminal is made of nickel and copper.

5 Claims, 6 Drawing Sheets

(56) References Cited

U.S. PATENT DOCUMENTS

| | | | | |
|---|---|---|---|---|
| 8,777,672 | B2 * | 7/2014 | Chung | H01R 13/6461 439/607.35 |
| 8,814,583 | B2 * | 8/2014 | Naito | H01R 24/60 439/188 |
| 8,905,779 | B2 * | 12/2014 | Little | H01R 13/641 439/489 |
| 8,920,197 | B2 * | 12/2014 | Tziviskos | H01R 13/405 439/660 |
| 8,956,179 | B2 * | 2/2015 | MacDougall | H01R 13/641 439/489 |
| 8,974,240 | B2 * | 3/2015 | Yu | H01R 29/00 439/188 |
| 9,281,634 | B2 * | 3/2016 | Katayanagi | H01R 29/00 |
| 9,325,123 | B2 * | 4/2016 | Yu | H01R 13/641 |
| 9,391,410 | B2 * | 7/2016 | Yu | H01R 13/6594 |
| 2013/0316592 | A1 * | 11/2013 | Yu | H01R 13/516 439/660 |

* cited by examiner

ELECTRICAL CONNECTOR WITH IMPROVED CONTACTS

BACKGROUND OF THE INVENTION

1. Field of the Invention

The present invention relates to an electrical connector, and more particularly to an electrical connector having a plurality of terminals with steadily transmitting current.

2. Description of Prior Arts

Traditional I/O connector includes a plurality of terminals used for transferring current or signal, and the terminals are made of brass or phosphor copper. The terminals can steadily transfer current of 1.8 A, but when the terminals transfer current of 5 A, temperature of the terminals rise fast and impedance of the terminals increase. In this case, the current transmitting by the terminals can not achieve to 5 A and the current transmission of the terminals of the traditional I/O connector is unsteady.

An electrical connector having a plurality of terminals with steadily current transmission is desired.

SUMMARY OF THE INVENTION

An electrical connector includes an insulative housing, a plurality of terminals received in the insulative housing and a shell. The insulative housing has a base portion and a tongue plate extending from the base portion forwardly. The tongue plate has a mating face and a supporting face opposite to the mating face. The terminals have a pair of signal terminals defined in the supporting face, a grounding terminal and a power terminal. The pair of signal terminals are defined between the grounding terminal and the power terminal. A thickness of the power terminal is greater than 0.2 mm, and the power terminal is made of nickel and copper.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
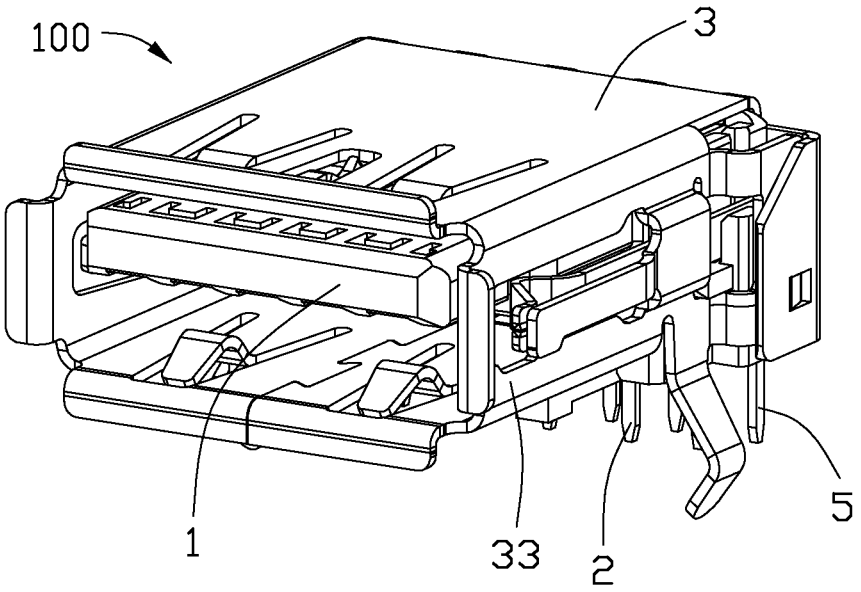
FIG. 1 is a perspective view of an electrical connector in accordance with the present invention.
Figure 2:
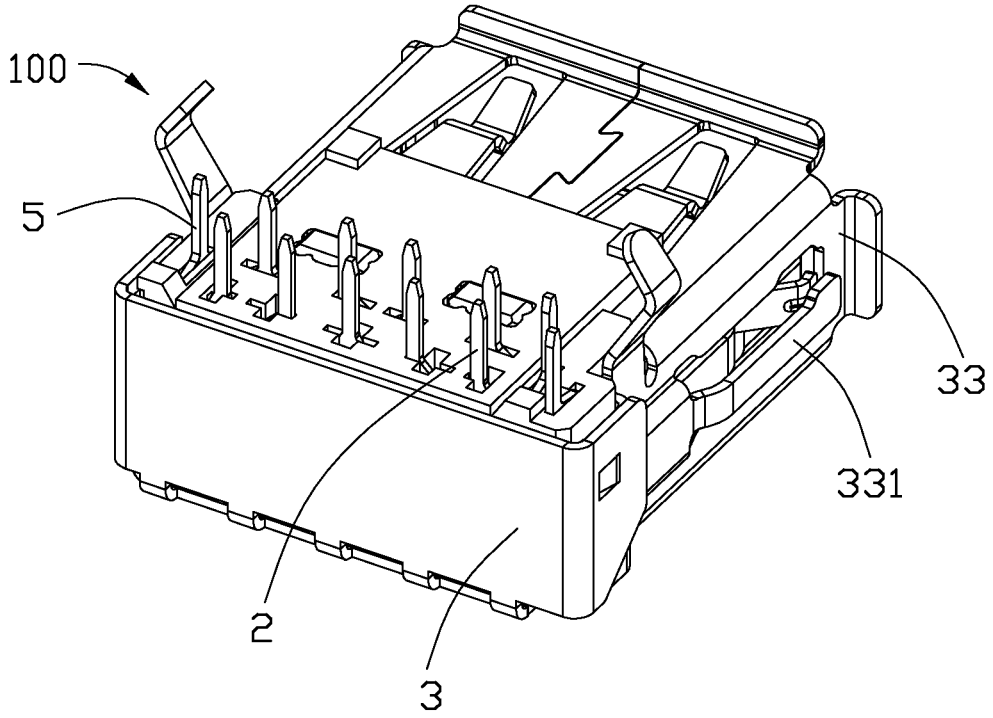
FIG. 2 is another perspective view of an electrical connector as shown in FIG. 1.

Reference will now be made to the drawing figures to describe the present invention in detail.

FIGS. 1-6 show an electrical connector 100 used for being mounted onto an external printed circuit board. The electrical connector 100 includes an insulative housing 1, a plurality of terminals 2 received in the insulative housing 1, a shell 3 covering the insulative housing 1, a plurality of detecting terminals 5, and a terminal block 6.

Figure 3:
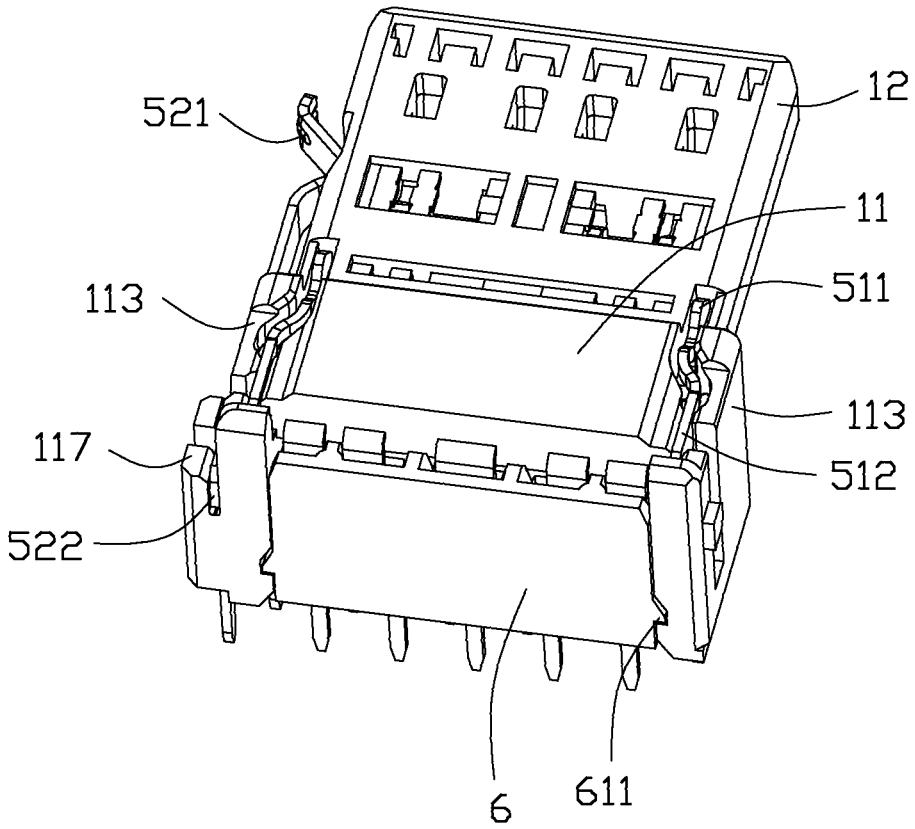
FIG. 3 is a perspective view of an electrical connector without a shell in FIG. 2.
Figure 4:
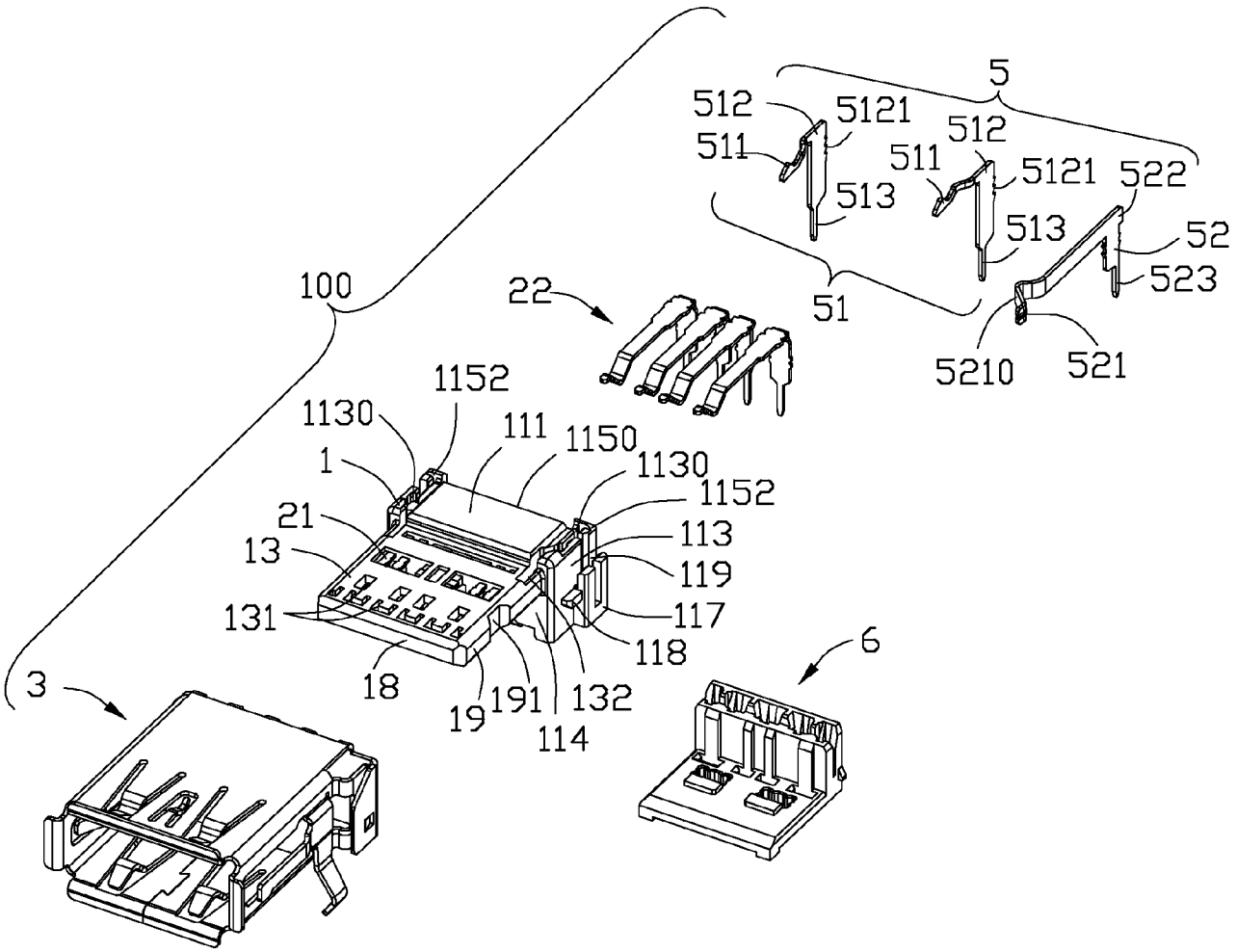
FIG. 4 is an exploded view of the electrical connector in FIG. 2.
Figure 5:
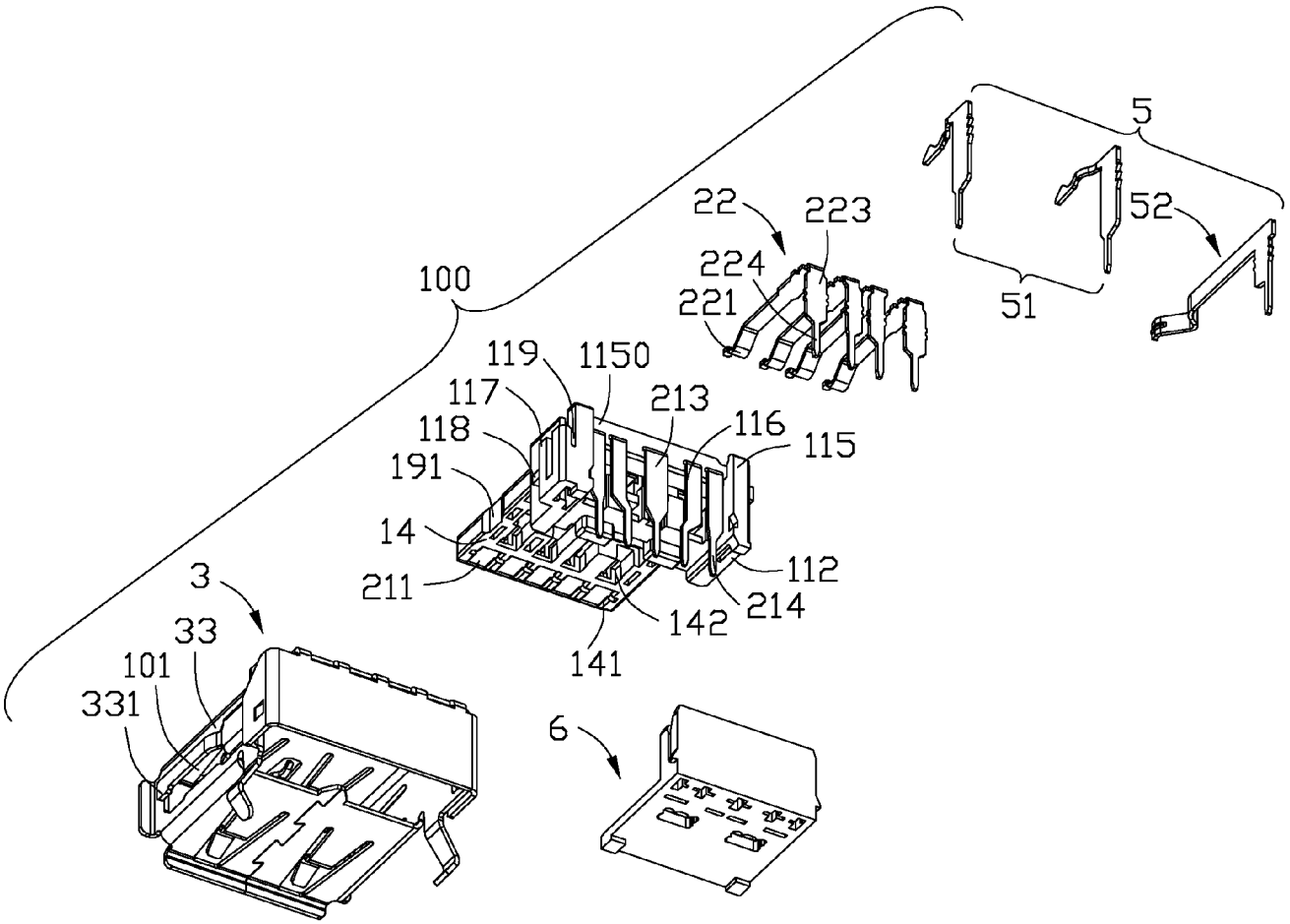
FIG. 5 is another exploded view of the electrical connector in FIG. 4.
Figure 6:
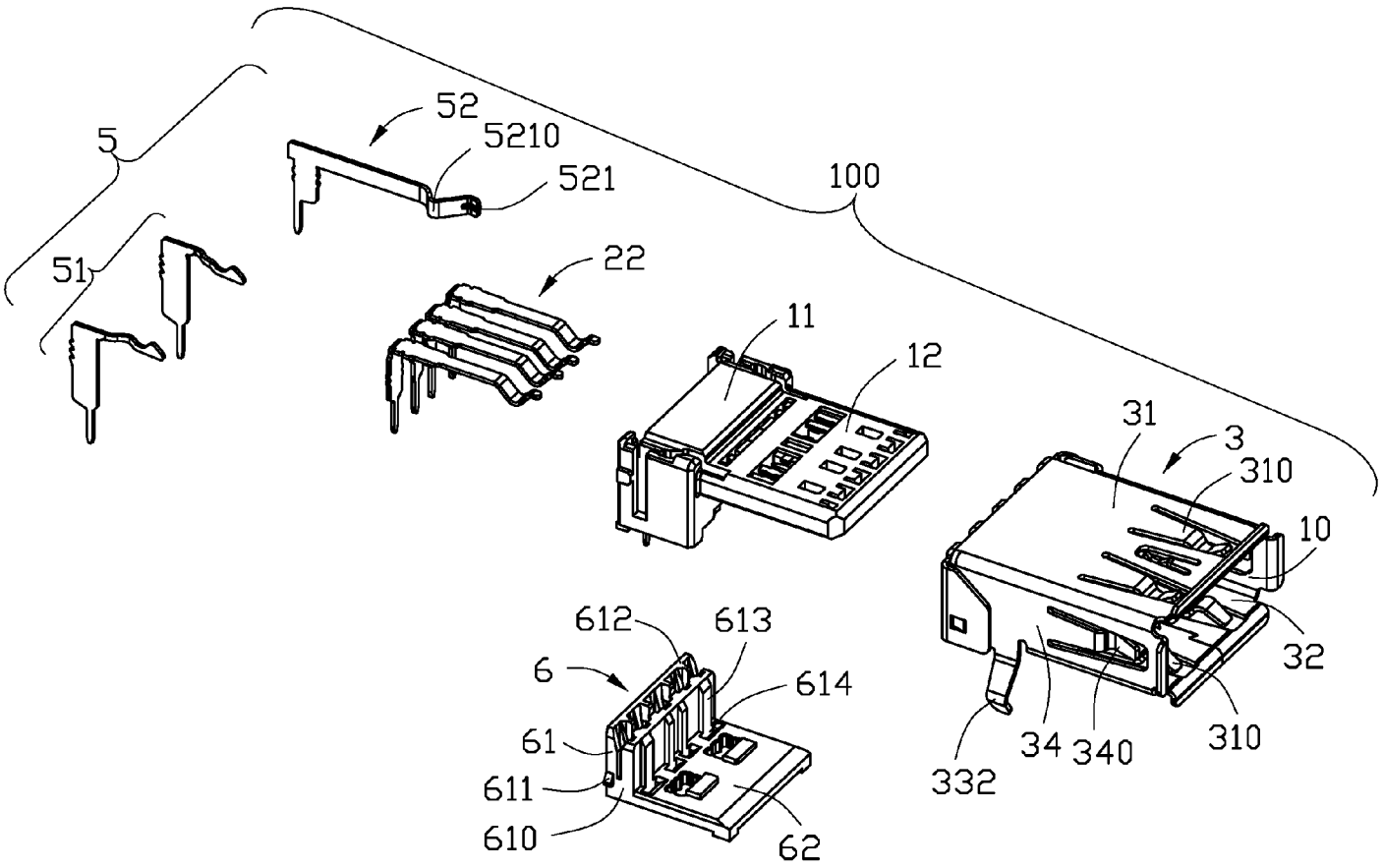
FIG. 6 is another exploded view of the electrical connector in FIG. 5.

FIGS. 3-5 show the insulative housing 1 including a base portion 11 and a tongue plate 12 extending from the base portion 11 forwardly. The base portion 11 includes an upper surface 111, a lower surface 112, two lateral portions 113, a front surface 114, and a rear surface 115. The base portion 11 includes two receiving cavities 1130 recessed from the upper surface 111 downwardly, and the two receiving cavities 1130 are defined at two side of the base portion 11. The base portion 11 also includes a receiving space 1150 recessed from the rear surface 115 forwardly, and the terminal block 6 is received in the receiving space 1150. The two receiving cavities 1130 are not connected with the receiving space 1150. The base portion 11 includes two resisting portions 1152 disposed behind the receiving cavity 1130 respectively, and the resisting portions 1152 are used for supporting the detecting terminals 5 forwardly. The receiving cavity 1130 extends through the lateral portions 113 outwardly and through the lower surface 112 of the base portion 11 downwardly, but does not extend through the rear surface 115. The base portion 11 includes a plurality of positioning slots 116, and the positioning slots 116 extend through the base portion 11 along a front-to-back direction for receiving and positioning the terminals 2. The positioning slots 116 are connected with the receiving space 1150. The positioning slots 116 are defined between the two receiving cavities 1130. The base portion 11 includes an additional portion 117, a supporting platform 118 defined in front of the additional portion 117, and a fixing cavity 119 defined between the lateral portion 113 and the additional portion 117. The additional portion 117 is defined on the lateral portion 113 on the left. The fixing cavity 119 is connected with the receiving cavity 1130.

FIGS. 4-5 show the tongue plate 12 including a mating face 13 defined on upside of the tongue plate 12, a supporting face 14 opposite to the mating face 13, a front face 18, and two lateral faces 19. The mating face 13 includes a plurality of positioning holes 131. The tongue plate 12 includes a front end and a rear end. The tongue plate 12 includes a plurality of first receiving slots 141 recessed from the supporting face 14 at the front end thereof and a plurality of second receiving slots 142 recessed from the supporting face 14 at the rear end thereof The first receiving slots 141 are not connected with the second receiving slots 142. The second receiving slots 142 are connected with the positioning slots 116 of the base portion 11. The tongue plate 12 includes two spaces 132 each recessed from the mating face 13 downwardly at two sides thereof, and the space 132 is connected with the receiving cavity 1130 and used for receiving and fixing the detecting terminals 5. The tongue plate 12 includes a recessing portion 191 recessed from one of the lateral faces 19 inwardly on the left of the tongue plate 12.

FIGS. 2-5 show the terminals including a plurality of first or stationary terminals 21 inserted molded into the tongue plate 12 and a plurality of second or moveable terminals 22 received in the second receiving slots 142 respectively. The first terminal 21 includes a first mating portion 211 received in the first receiving slot 141, and the first mating portion 211 is defined inside of the supporting face 14. The second terminal 22 includes a second mating portion 221 received in the second receiving slot 142, and the second mating portion 221 extends beyond the supporting face 14 of the tongue plate 12.

The four second terminals 22 include a pair of signal terminals, a grounding terminal, and a power terminal. The pair of signal terminals are defined between the grounding terminal and the power terminal. A thickness of the second terminal 22 is greater than 0.2 mm, so as to have a lower impedance when the second terminals 22 transfer a big current, such as current of 5 A. Furthermore, the second terminals 22 are made of nickel and copper, so when the power terminal transfers current of 5 A, temperature of the power terminal rises less than 30, so as to avoid the impedance of the power terminal from rising and make a current transmission of the second terminals steady. The thickness of the second terminal can be 0.21~0.4 mm, optimize for 0.25 mm and 0.30 mm FIGS. 4-5 show a shell 3 including an upper wall 31, a lower wall 32, a left wall 33, and a right wall 34. The upper wall 31 and the lower wall 32 each include two first elastic slices 310 protruding inwardly. The right wall 34 includes a second elastic slice 340 protruding inwardly. The first elastic slices 310 and the second elastic slice 340 are used for holding a plug connector. The left wall 33 and the right wall 34 each include a mounting foot 332 extending downwardly, and the mounting foot 332 is used for being mounted onto the external circuit board. The left wall 33 includes a detecting elastic slice 331 protruding from the left wall outwardly.

The detecting terminals 5 include a pair of first detecting terminals 51 received in the receiving cavities 1130 respectively and a second detecting terminal 52 received into the fixing cavity 119. The first detecting terminals 51 extend vertically. The first detecting terminal 51 includes a first main portion 512, a soldering foot 513 extending from one end of the first main portion 512 downwardly and beyond the lower surface 112 of the base portion 11, and a first contacting portion 511 extending from the other end of the first main portion 512 forwardly to the space 132 of the tongue plate 12. The first main portion 512 includes a plurality of barbs 5121. The first detecting terminals 51 are mounted into the receiving cavity 1130 from the upper to lower direction. The barbs 5121 of the first detecting terminals 51 engage with the resisting portion 1152 of the base portion 11, so that the first detecting terminals 51 is received in the receiving cavity 1130 steadily. When a plug connector is inserted into the electrical connector 100, the resisting portion 1152 holds the first main portion 512 of the first detecting terminal 51 forwardly. The first contacting portion 511 extends along the upper to lower direction, and beyond the mating face 13 of the tongue plate 12.

The second detecting terminal 52 includes a second main portion 522 received in the fixing cavity 119, a second contacting portion 521 extending from one end of the second main portion 522 forwardly to a free space 101, and a second soldering foot 523 extending from the other end of the second main portion 522 downwardly. The second soldering foot 523 is used for being mounted onto the external circuit board. The second contacting portion 521 includes a projecting portion 5210 protruding to the recessing portion 191. The second contacting portion 521 is closed to a front edge of the tongue plate 12, and the first contacting portion 511 is defined behind the tongue plate 12 and is closed to the front surface 114 of the base portion 11.

The electrical connector 100 can not only mate with a standard USB plug connector, but also mate with a USB PD plug connector used for transferring large current. The electrical connector 100 can identify a type of the plug connector by the two first detecting terminals 51 and the second detecting terminal 52. A mating portion of the USB PD connector is longer than a respective mating portion of the standard USB plug connector. When the standard USB connector is inserted into the electrical connector 100 completely, a shell of the standard USB connector presses the projecting portion 5210 of the second contacting portion 521 outwardly, then the second contacting portion 521 moves outwardly and engages with the detecting elastic slice 331 of the electrical connector 100. As the standard USB plug connector can not touch the first contacting portion 511 of the first detecting terminal 51, the first contacting portion 511 can not transfer signal to the other first detecting terminal 51 by the shell of the plug connector, so the electrical connector 100 can identify the standard USB plug connector. When the USB PD plug connector with the longer mating portion is inserted into the electrical connector 100, the longer mating portion can touch the first contacting portion 511 of the first detecting terminal 51, and the first detecting terminal 51 can transfer signal to the other first detecting terminal 51 by the shell of the plug connector, then the electrical connector 100 can identify the USB PD connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An receptacle connector for mating with a plug connector, comprising:

an insulative housing including a base and a mating tongue extending forwardly therefrom;

a plurality of passageways formed in the housing;

a plurality of movable terminals disposed in the corresponding passageways, respectively, with corresponding up-and-down deflectable mating sections exposed upon a mating face of the mating tongue in a vertical direction; and a plurality of stationary terminals disposed in the housing with corresponding stationary mating sections exposed upon said mating face of the mating tongue in front of the deflectable mating sections; wherein a thickness of the movable terminal different from that of the stationary terminal, is greater than 0.2 mm;

further including a rear detecting terminal and a front detecting terminal, a thickness direction of both said rear detecting terminal and said front detecting terminal extending essentially in a transverse plane perpendicular to said vertical direction, and during mating with said plug connector, said front detecting terminal being deflectable in a transverse direction perpendicular to said vertical direction while said rear detecting terminal being deflectable in said vertical direction.

2. The receptacle connector as claimed in claim 1, wherein material al of said moveable terminal is an alloy of nickel and copper.

3. The receptacle connector as claimed in claim 1, wherein the thickness of the moveable terminal is larger than that of the stationary terminal.

4. The receptacle connector as claimed in claim 1, wherein a thickness of each of said rear detecting terminal and said front detecting terminal is smaller than that of the moveable terminal.

5. The receptacle connector as claimed in claim 1, wherein the moveable terminals are materially different from the stationary terminals.

* * * * *